US005086945A

United States Patent [19]

Corella

[11] Patent Number: 5,086,945

[45] Date of Patent: Feb. 11, 1992

[54] TABLET SELECTOR AND PACKAGING SYSTEM USING SAME

[76] Inventor: Arthur P. Corella, 8166 Vanscoy Ave., North Hollywood, Calif. 91602

[21] Appl. No.: 491,169

[22] Filed: Mar. 9, 1990

[51] Int. Cl.[5] ..... B65G 59/00

[52] U.S. Cl. ..... 221/13; 221/203; 221/206; 221/207; 221/252; 221/258; 221/265

[58] Field of Search ..... 221/13, 202, 203, 206, 221/207, 252, 258, 263, 264, 265; 53/237, 551

[56] References Cited

U.S. PATENT DOCUMENTS 2,742,184 4/1956 Yerkes et al. ..... 221/265 X 3,281,012 10/1966 Martell ..... 221/265 X 3,628,694 12/1971 Nichols ..... 221/265

4,676,399 6/1987 Burckhardt ..... 221/207

*Primary Examiner*—David H. Bollinger

*Attorney, Agent, or Firm*—Donald Diamond

[57] ABSTRACT

A tablet selector has a selector plate interposed between a tablet-carrying rotatable disk having a plurality of pairs of first and second openings, and a pair of discharged tubes which lead to a form, fill and seal packaging station. The selector plate is pivotally movable by solenoid actuators to selectively block one or the other of the first and second openings of the rotatable disk. A pneumatic cylinder has an expandable arm which drives the selector plate into a complete blocking position.

15 Claims, 3 Drawing Sheets

TABLET SELECTOR AND PACKAGING SYSTEM USING SAME

BACKGROUND OF THE INVENTION

1. Field of the Invention

The present invention relates generally to the field of packaging and, more specifically, to a tablet selector and packaging system employing same.

2. Description of the Related Art

It is known to provide a tablet selector with a rotatable disk having plural pairs of openings formed in a peripheral region thereof. The openings are used to pass tablets placed on the disk through feeder tubes which lead to a packaging and sealing station. The disk is rotated to advance the pairs of perforations sequentially to an opening provided in a support plate which overlies the feeder tubes. Thus, tablets are fed in pairs at a speed dictated by the speed of the motor which drives the rotatable disk.

With the known device, it is not possible to vary the feed of tablets through the openings, other than to vary the speed of the drive motor. Moreover, the known device does not lend itself to use with a tablet packaging system in which various types of tablets are supplied to a single package, or in which various quantities of different tablets can be supplied to a single package.

SUMMARY OF THE INVENTION

An object of the present invention is to provide a tablet selector and feeder system for a tablet packaging system which facilitates the customization of tablet packaging.

Another object of the present invention is to provide a tablet selector and feeder system which is capable of sending predetermined quantities and combinations of different tablets to individual packages.

Another object of the present invention is to provide a tablet packaging system incorporating a plurality of tablet selectors, and which is capable of being controlled centrally by a computer.

These and other objects of the invention are met by providing a tablet selector which includes a rotatable disk having an upper surface and a plurality of pairs of first and second openings disposed radially at a peripheral region of the disk, a bin disposed around the disk for collecting tablets on the upper surface of the disk, a stationary support plate disposed under the disk and having a peripheral region, a selector plate pivotally mounted in the peripheral region of the stationary support plate and having an opening, first drive means for actuating the selector plate for pivotal movement between access and blocking positions in which the opening of the selector plate is rotated in and out of vertical alignment with the plurality of pairs of first and second openings, second drive means for rotating the rotatable disk to successively move the plurality of pairs of first and second openings to a position overlying the selector plate, and control means for outputting control signals to the first and second drive means according to a control program.

A tablet packaging system according to the present invention employs at least two of the aforementioned tablet selectors, each containing a different type of tablet, and the control means provides control signals which operate the tablet selectors in a prescribed pattern to provide one, two or no tablets from each tablet selector. This results in a customized package of different types and quantities of tablets depending on individual customer needs.

These and other features and advantages of the tablet selector and tablet packaging system incorporating same according to the present invention will become more apparent with reference to the following detailed description and drawings.

DETAILED DESCRIPTION OF THE PREFERRED EMBODIMENTS

Figure 1:
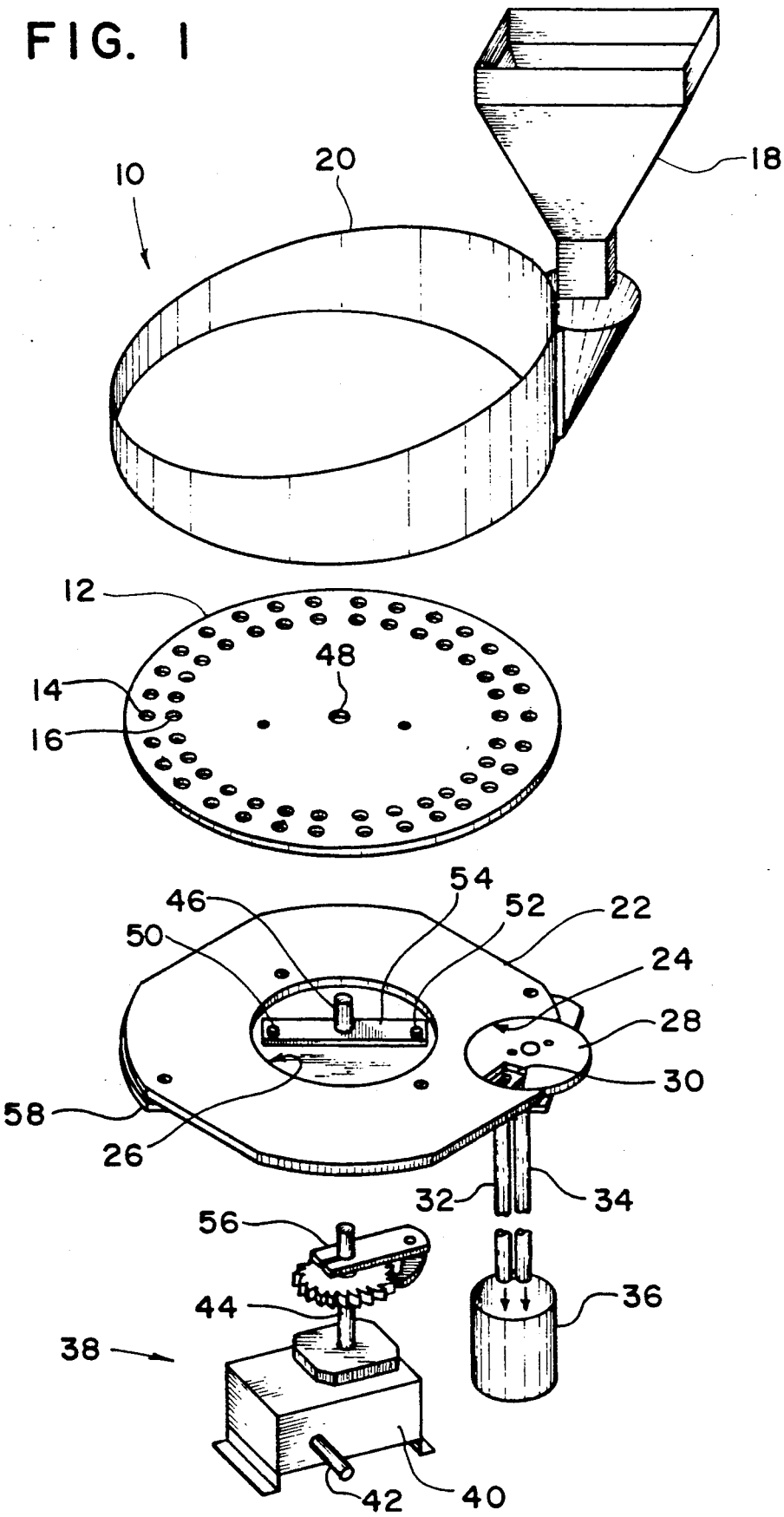
FIG. 1 is an exploded view of a tablet selector according to the present invention.

Referring to FIG. 1, a tablet selector according to the present invention is generally referred to by the numeral 10. The tablet selector 10 includes a rotatable disk 12 having an upper surface and a plurality of pairs of first and second openings 14 and 16, respectively. The first openings 14 have a common radius, whereas the second opening 16 have a smaller, common radius. The pairs of openings are disposed radially at a peripheral region of the disk 12, and are adapted to receive tablets, preferably elongated tablets, one per opening. The tablets are fed onto the upper surface of the disk 12 through a hopper 18 coupled to a bin 20. The bin 20 is disposed around the disk 12 for collecting tablets on the upper surface of the disk 12. The tablets are induced to move into the first and second openings 14 and 16 when the disk 12 is caused to rotate by a drive motor.

A stationary support plate 22 is disposed under the disk 12 and includes a cut-out region or opening 24 which has a crescent-shape. The opening 24 is formed in a peripheral region of the stationary support plate 22 beneath the area of the first and second openings 12 and 14. A central opening 26 is formed in the stationary plate 22 to accommodate a drive mechanism, to be described in more detail below, which couples the disk 12 to drive means.

A selector plate 28 is pivotally mounted in the peripheral region of the stationary support plate 22 and includes an opening 30 which is positioned under the rotatable disk 12 at the radii of the first and second openings 14 and 16, so that tablets can pass freely through the first and second openings and through the opening 30.

A first drive means (not shown in FIG. 1) is used to actuate the selector plate 28 for pivotal movement between access and blocking positions in which the opening of the selector plate 28 is rotated in and out of vertical alignment with the plurality of pairs of first and second openings 14 and 16. In the open position, the opening 30 would underlie a pair of first and second openings 14 and 16 when rotated into position by second drive means which is used to rotate the disk 12. Thus, with the opening 30 positioned under a pair of openings, a pair of tablets held in the aligned pair of openings would fall through the opening 30, into discharge tubes 32 and 34 and subsequently into a conventional form, fill and seal packaging station 36.

If it is desired to block one or the other of the first and second openings 14 and 16, the selector plate 28 can be rotated in either direction through an angle sufficient to remove the opening 30 from the peripheral region of the disk 12 which includes the plurality of pairs of first and second openings 14 and 16, respectively. The selector plate 28 is rotated through an angle so that the opening 30 of the selector plate 28 is positioned under only one (either one) of the pair of first and second openings 14 and 16. In order to move the selector plate 28 into a position in which either one, but not both, of the first and second openings 14 and 16 is blocked, the selector plate 28 may be rotated in either direction, depending on which opening it is desired to have opened.

A second drive means 38 rotates the rotatable disk 12 to successively move the plurality of pairs of first and second openings 14 and 16 to a position overlying opening of the selector plate 28. The drive means 38 may include a transmission 40 having an input shaft 42 which may be coupled to a drive motor through a chain and sprocket or other suitable means. An output shaft 44 which includes a hub 46 which passes through a mounting hole 48 provided centrally on the rotating disk 12. Lugs 50 and 52 provided on a support bar 54 fixedly connected to the hub 46 interlock the rotating disk 12 with output of the drive shaft. The output of the drive shaft 44 may be interrupted by a ratchet mechanism 56 which ensures rotation in only one direction. Other drive means may be included, such as an electric stepping motor.

Figure 2:
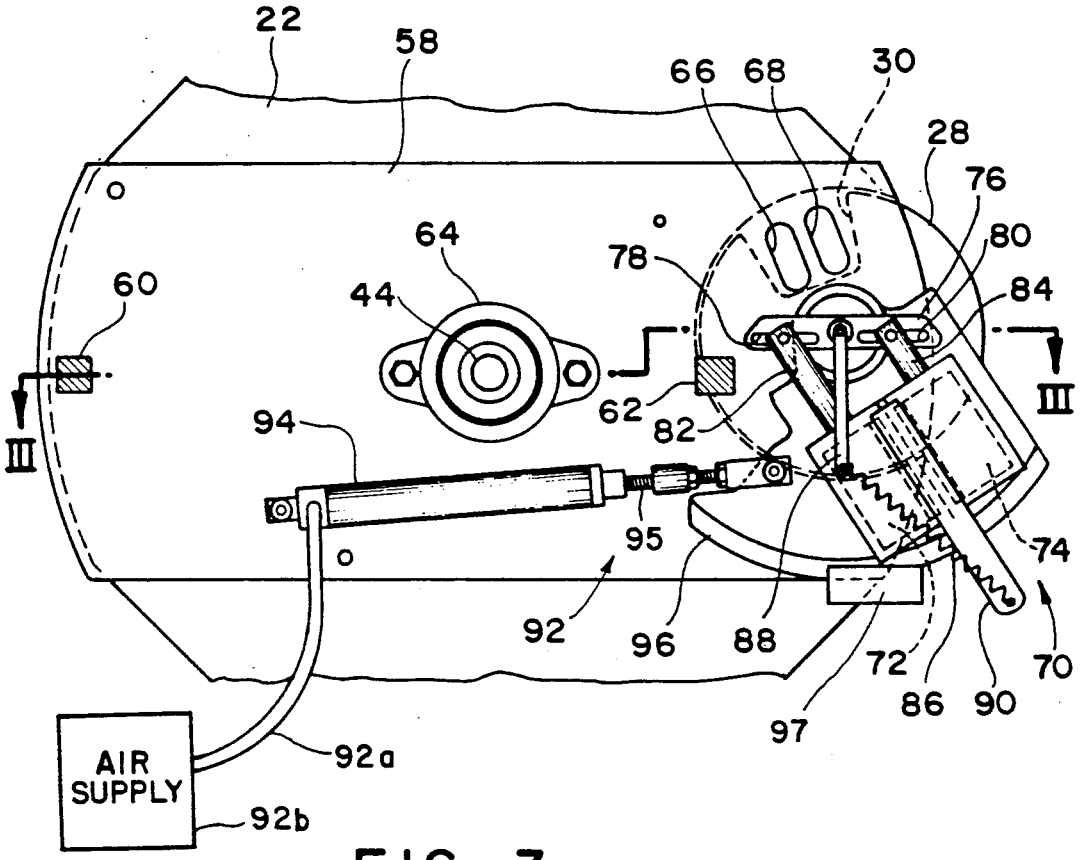
FIG. 2 is a bottom view of the tablet selector of FIG. 1.
Figure 3:
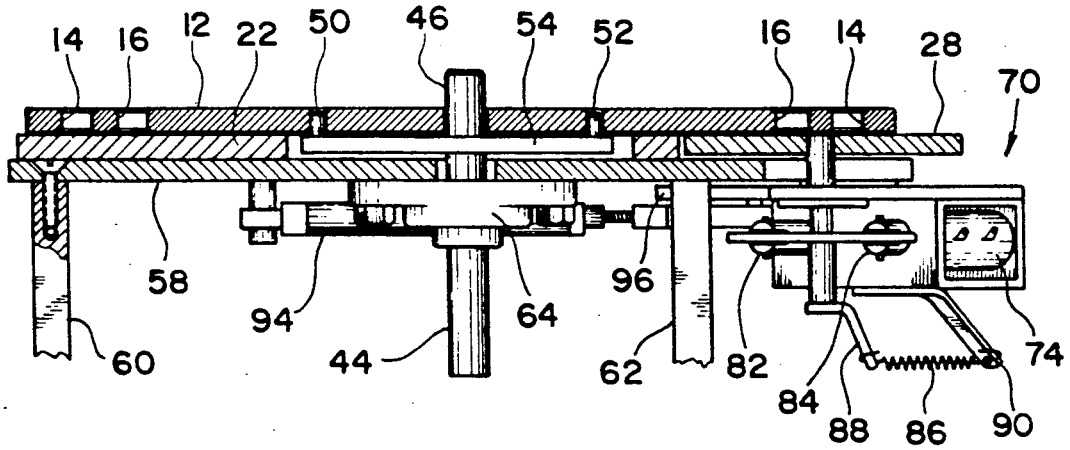
FIG. 3 is a cross-sectional view taken along line III—III of FIG. 2.

Details of the drive means which actuate the selector plate 28 are shown in FIGS. 2 and 3. A base plate 58 supports the support plate 22 and has legs 60 and 62. The drive shaft 44 is journalled for rotation in a roller bearing 64 mounted on the base plate. A pair of openings 66 and 68 are formed in the base plate 58 in a position to be substantially vertically aligned with the first and second openings 14 and 16 provided in the peripheral region of the rotatable disk 12. Thus, as illustrated in FIG. 2, when the opening 30 of the selector plate 28 is positioned between the openings 66, 68 of the base plate 58, and the openings and 16 of the rotatable disk 12, with the openings being vertically aligned, a passage is formed which permits the discharge of tablets to the discharge tubes.

The selector plate 28 is pivotally mounted in the base plate 58 and is provided with actuator means 70. The actuator means 70 includes a pair of solenoid actuators 72 and 74 which can be alternately energized to effect the desired position. A linkage 76 is rotatable with the selector plate 28 and includes a pair of elongated, longitudinally disposed slots 78 and 80. The slots 78 and 80 provide a variable fulcrum where the solenoid arms 82 and 84 are slidably connected to the linkage 76.

A spring return mechanism includes a spring 86 and a moment arm 88 which is fixedly connected to the linkage 76. The spring has one end connected to the moment arm 88 and the opposite end connected to a support 90 so that if the left-hand solenoid 72 is actuated, a spring bias is generated to help return the selector plate 28 to its original position.

A pneumatic actuator 92 is mounted on the base plate 58 to increase the range of movement of the selector plate 28 so as to permit complete blocking of the openings 12 and 14. The actuator 92 includes a body 94 and an extendable arm 95 which is coupled through a clevis joint to a swing plate 96 on which the solenoid actuators 72 and 74 are mounted. The selector plate 28 rotates with the swing plate 96 even though both are independently mounted. This is because the selector plate 28 and the swing plate are indirectly connected through the actuator arms 82 and 84.

The extendable arm 95 causes the swing plate 96 to move in a counter-clockwise direction as viewed in FIG. 2. Although the selector plate 28 and the swing plate 96 are not directly coupled together, since the solenoid actuators 72 and 74 are carried by the swing plate 96, and since they are coupled to the selector plate 28 through arms 80, 82 and linkage 76, the selector plate 28 will rotate counter-clockwise with the swing plate. A guide 97 is provided at the peripheral edge of the swing plate 96 for guiding the swinging movement thereof. By virtue of the swing plate moving counter clockwise, the selector plate 28 also moves counter clockwise to a point where it completely blocks the two openings 66 and 68 and the openings 14 and 16.

The actuator 92 is supplied with air through line **92*a* which is coupled to a supply 92*b* of compressed air. The supply 92*b*** may be an air compressor having a storage tank and release valve operated by control signals supplied by a central control unit or computer.

Figure 4:
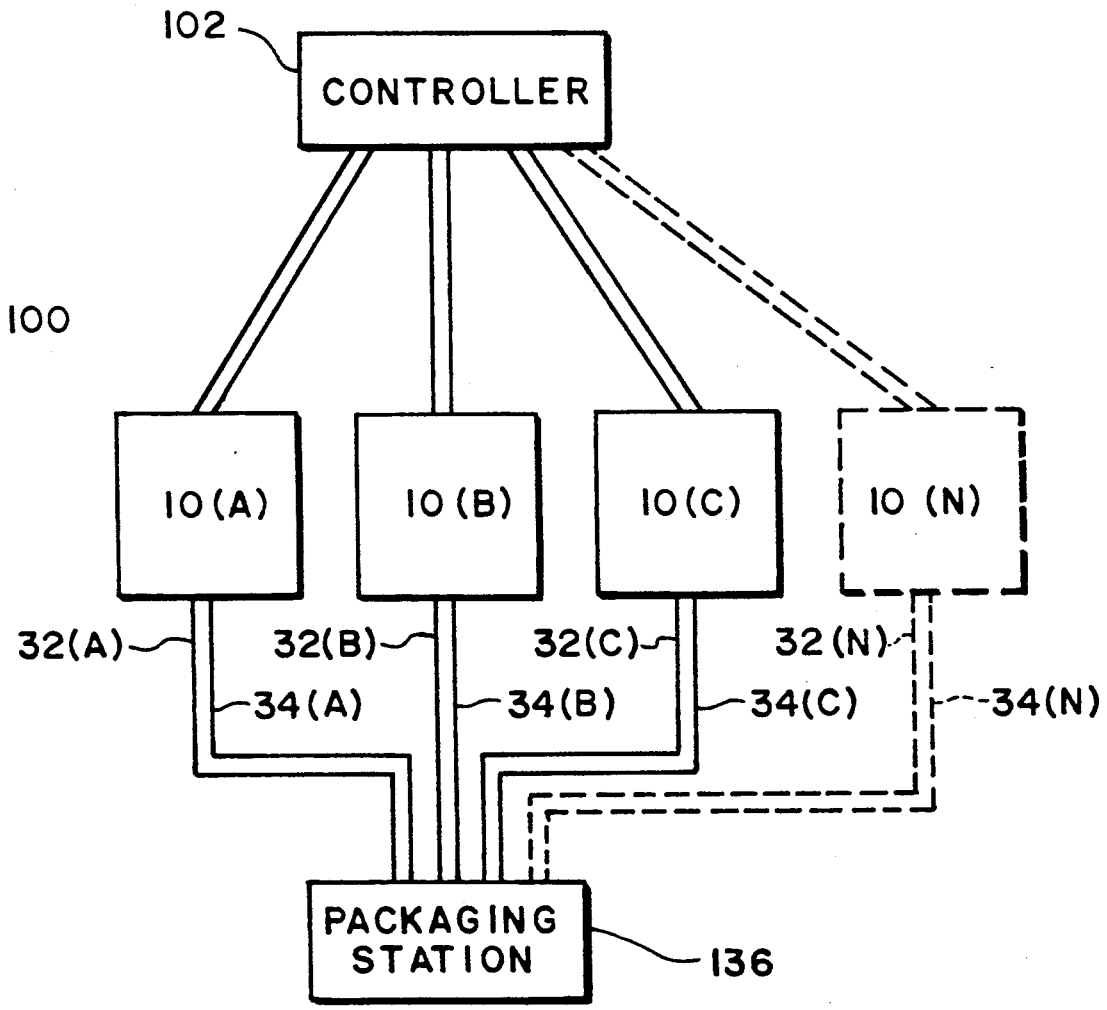
FIG. 4 is a schematic view of a tablet packaging system according to the present invention, incorporating a plurality of the tablet selectors illustrated in FIGS. 1 through 3.

Referring to FIG. 4, a tablet packaging system according to the present invention is generally referred to by the numeral 100. A controller 102 sends control signals to the drive means in each of the tablet selectors 10(A), 10(B), 10(C) . . . 10(N). The tablet selectors correspond to the one described above, and each is thus capable of supply one, two or no tablets, depending on the position of the selector plate 28. The selector plate position is controlled by the computer which sends control signals to the solenoids 72, 74, the drive motor 38 and/or the actuator 92.

Each tablet selector has discharge chutes 32A, 34A through 32N, 34N. The various discharge chutes lead to a form, fill and seal packaging station 136 which is capable of producing individualized packages containing a predetermined mixture and quantity of tablets. For example, a customized package of vitamins can be produced by programming the controller, which may be a computer, to output control signals to the various tablet selectors to provide the requisite number and mixture of tablets. For example, each of the tablet selectors could contain a different type of tablet, and depending on the program fed into the controller, customized packages can be produced on a rapid, production line basis.

Numerous modifications and adaptations of the present invention will be apparent to those so skilled in the art and thus, it is intended by the following claims to cover all such modifications and adaptations which fall within the true spirit and scope of the invention.

What is claimed:

1. A tablet selector comprising:

storage means for holding a quantity of tablets, outlet means, associated with the storage means, for releasing tablets in variably selectable quantities from the storage means, and means, associated with the outlet means, for controlling release of tablets through the outlet means, wherein the storage means comprises a rotatable disk having an upper surface and a bin disposed around the disk for collecting tablets on the upper surface of the disk, where the outlet means comprises a plurality of pairs of first and second openings disposed radially at a peripheral region of the disk, wherein the controlling means comprises a stationary support plate disposed under the disk and having a peripheral region, a selector plate pivotally mounted in the peripheral region of the stationary support plate and having an opening, first drive means for actuating the selector plate for pivotal movement between access and blocking positions in which the opening of the selector plate is rotated in and out of vertical alignment with the plurality of pairs of first and second openings, second drive means for rotating the rotatable disk to successively move the plurality of pairs of first and second openings to a position overlying the selector plate, and control means coupled to the first and second drive means for outputting control signals to the first and second drive means in accordance with a control program.

2. A tablet selector according to claim 1, wherein the stationary support plate includes a peripheral opening in which the selector plate is pivotally movable.

3. A tablet selector according to claim 1, wherein the selector plate is pivotally mounted to the base plate, said base plate underlying the stationary support plate, and the first drive means includes a linkage fixedly connected to the selector plate and a motor having at least one reciprocating arm pivotally connected to the linkage for pivoting the selector plate through the linkage.

4. A tablet selector according to claim 3, wherein the first drive means further comprises a swing plate pivotally connected to the base plate and having a common pivot axis with the selector plate, and the motor comprises a pair of solenoid actuators, each having an arm pivotally and slidably connected to opposite end portions of the linkage, wherein the pair of solenoid actuators are mounted on the swing plate.

5. A tablet selector according to claim 4, wherein the first drive means includes a pneumatic cylinder having one end pivotally connected to the base plate and an opposite end pivotally connected to the swing plate, and an arm driven outwardly by pneumatic pressure, wherein outward extension of the arm causes swinging movement of the swing plate and thus the pair of solenoid actuators and linkage to move the opening of the selector plate out of vertical alignment with both the first and second openings of the rotatable disk.

6. A tablet selector according to claim 5, wherein the pair of solenoid actuators are operable to rotate the selector disk back and forth through an angle sufficient to alternately block one or the other of the pair of first and second openings of the rotatable disk.

7. A tablet selector according to claim 1, wherein the control means is a programmed computer.

8. A tablet selector according to claim 1, further comprising a base plate disposed under the stationary support plate and having a pair of openings substantially aligned with the first and second openings of the rotatable disk, a pair of discharge tubes in communication with the pair of openings provided in the base plate, and a form, fill and seal packaging station in communication with the pair of discharge tubes for receiving tablets fed from the rotatable disk.

9. A tablet selector comprising:

a rotatable disk having an upper surface and a plurality of pairs of first and second openings disposed radially at a peripheral region of the disk;

a bin disposed around the disk for collecting tablets on the upper surface of the disk;

a stationary support plate disposed under the rotatable disk and having a cut-out region formed in a peripheral region thereof for passing tablets discharged from the plurality of pairs of first and second openings to a form, fill and seal packaging station; and means disposed in the cut-out region of the stationary support plate for selectively blocking either one or both of the first and second openings of the rotatable disk.

10. A tablet selector according to claim 9, wherein the blocking means comprises:

a selector plate pivotally mounted in the peripheral region of the stationary support plate and having an opening;

first drive means for actuating the selector plate for pivotal movement between access and blocking positions in which the opening of the selector plate is rotated in and out of vertical alignment with the plurality of pairs of first and second openings;

second drive means for rotating the rotatable disk to successively move the plurality of pairs of first and second openings to a position overlying the selector plate; and control means coupled to the first and second drive means for outputting control signals to the first and second drive means in accordance with a control program.

11. A tablet selector according to claim 10, wherein the stationary support plate includes a peripheral opening in which the selector plate is pivotally mounted.

12. A tablet selector according to claim 10, wherein the selector plate is pivotally mounted to the base plate, said base plate underlying the stationary support plate, and the first drive means includes a linkage fixedly connected to the selector plate and a motor having at least one reciprocating arm pivotally connected to the linkage for pivoting the selector plate through the linkage.

13. A tablet selector according to claim 10, wherein the first drive means further comprises a swing plate pivotally connected to the base plate and having a common pivot axis with the selector plate and the motor comprises a pair of solenoid actuators, each having an arm pivotally and slidably connected to opposite end portions of the linkage, where the pair of solenoid actuators are mounted on the swing plate.

14. A tablet selector according to claim 13, wherein the first drive means includes a pneumatic cylinder having one end pivotally connected to the base plate and an opposite end pivotally connected to the swing plate, and an arm driven outwardly by pneumatic pressure, wherein outward extension of the arm causes swinging movement of the swing plate and thus the pair of solenoid actuators and linkage to move the opening of the selector plate out of vertical alignment with both the first and second openings of the rotatable disk.

15. A tablet selector comprising:

a rotatable disk having an upper surface and a plurality of pairs of first and second openings disposed radially at a peripheral region of the disk;

a bin disposed around the disk for collecting tablets on the upper surface of the disk;

a stationary support plate disposed under the disk and having a peripheral region;

a selector plate pivotally mounted in the peripheral region of the stationary support plate and having an opening;

first drive means for actuating the selector plate for pivotal movement between access and blocking positions in which the opening of the selector plate is rotated in and out of vertical alignment with the plurality of pairs of first and second openings;

second drive means for rotating the rotatable disk to successively move the plurality of pairs of first and second openings to a position overlying the selector plate; and control means coupled to the first and second drive means for outputting control signals to the first and second drive means in accordance with a control program.

* * * * *